US005594965A

United States Patent [19]

Vanzant

[11] Patent Number: 5,594,965

[45] Date of Patent: Jan. 21, 1997

[54] HOSPITAL BED ADJUSTABLE FOOT STOP

[76] Inventor: Teddy L. Vanzant, 2291 Indian Horse Dr., Norco, Calif. 91760

[21] Appl. No.: 543,294

[22] Filed: Oct. 16, 1995

[51] Int. Cl.[6] ..... A47C 20/02

[52] U.S. Cl. ..... 5/651

[58] Field of Search ..... 5/651, 648, 649, 5/650, 624, 658

[56] References Cited

U.S. PATENT DOCUMENTS

| | | | |
|---|---|---|---|
| 777,820 | 12/1904 | Taliaferro | 5/468 |
| 1,539,082 | 5/1925 | Fyler | 5/651 |
| 2,210,255 | 8/1940 | Peevey | 5/505.1 |
| 2,891,257 | 6/1959 | Posey | 5/651 |

*Primary Examiner*—Alexander Grosz

[57] ABSTRACT

A foot stop for a user resting on a mattress, the foot stop adapted to be removably attachable to said mattress, comprising a unitary, generally rigid structural member incorporating opposing U shaped sections at each end that have inner dimensions essentially equal to the thickness of the mattress, with the upper arms of the U shaped sections adapted to overlie and contact the top portion of the mattress, the lower arms of the U shaped sections adapted to underlie and contact at least a portion of the bottom of the mattress, the upper arms of the U shaped sections that are adapted to overlie the top portion of the mattress having an offset foot rest area generally overlying a central area of the mattress, and adapted to provide a support for the soles of the feet of a user.

3 Claims, 2 Drawing Sheets

HOSPITAL BED ADJUSTABLE FOOT STOP

BACKGROUND-FIELD OF INVENTION

The present invention relates to a method and apparatus for providing an adjustable foot stop for use on hospital type beds.

BACKGROUND-DESCRIPTION OF PRIOR ART

Hospital type beds typically are equipped so that the head of the bed can be elevated to maintain the user in a position where the upper part of the body is elevated either for comfort or medical reasons.

Persons using these beds encounter the problem that when the head is elevated the body tends to seek a lower level due to the pull of gravity and thus the body slowly and constantly slides toward the foot of the bed either until the feet make contact with the footboard of the bed or the body stops its slide when the forces of friction between the body and the bed exceed the forces available by the mass of the elevated portion of the body.

Early on, individuals attempted to solve this problem by stuffing pillows or other material between the persons feet and the footboard of the bed, which works somewhat for the very tall person and increasingly less well for the shorter person due to the quantity of material required to be stuffed.

Thereafter, inventors created mechanisms for providing a foot stop for use on hospital beds which typically connect to the foot board portion of the bed. These devices typically consist of mechanisms that are somewhat complicated and require special skills and tools to install or remove and have limited use with regards to how far the foot stop can be adjusted. Thus if the person requiring the use of the foot stop was shorter than the height allowed for in the invention additional material was needed to be stuffed between the persons feet and the installed foot stop.

There is a great need for an inexpensive method and means for providing an infinetly adjustable foot stop to hospital beds and it is an object of the present invention to provide a method and means for such function. It is a further object to provide a method and means which are relatively easy and fast to employ by anyone of ordinary skill without the necessity for the use of complicated tools or equipment. These and other objects will be apparent from the following description of the invention.

OBJECTS AND ADVANTAGES

Several objects and advantages of the present invention are:

(a) to provide a foot stop that is simple to use by persons with ordinary skill and without the need for special tools;

(b) to provide a foot stop that is more durable than existing products because of its simplicity of design and;

(c) to provide a foot stop that is easy to clean because of the limited number of parts;

(d) to provide a foot stop that is less expensive than existing products;

(e) to provide a foot stop that is infinetly adjustable;

DRAWING FIGURES

REFERENCE NUMERALS IN DRAWINGS

10 Foot Stop

12 Foot Stop Overall Length

14 Height of U Sections

16 Center Line of U section legs Interconnected

18 Center Line of U section legs not interconnected

20 Foot Rest Area

22 Mattress

DETAILED DESCRIPTION OF THE PREFERRED EMBODIMENTS

Figure 1:
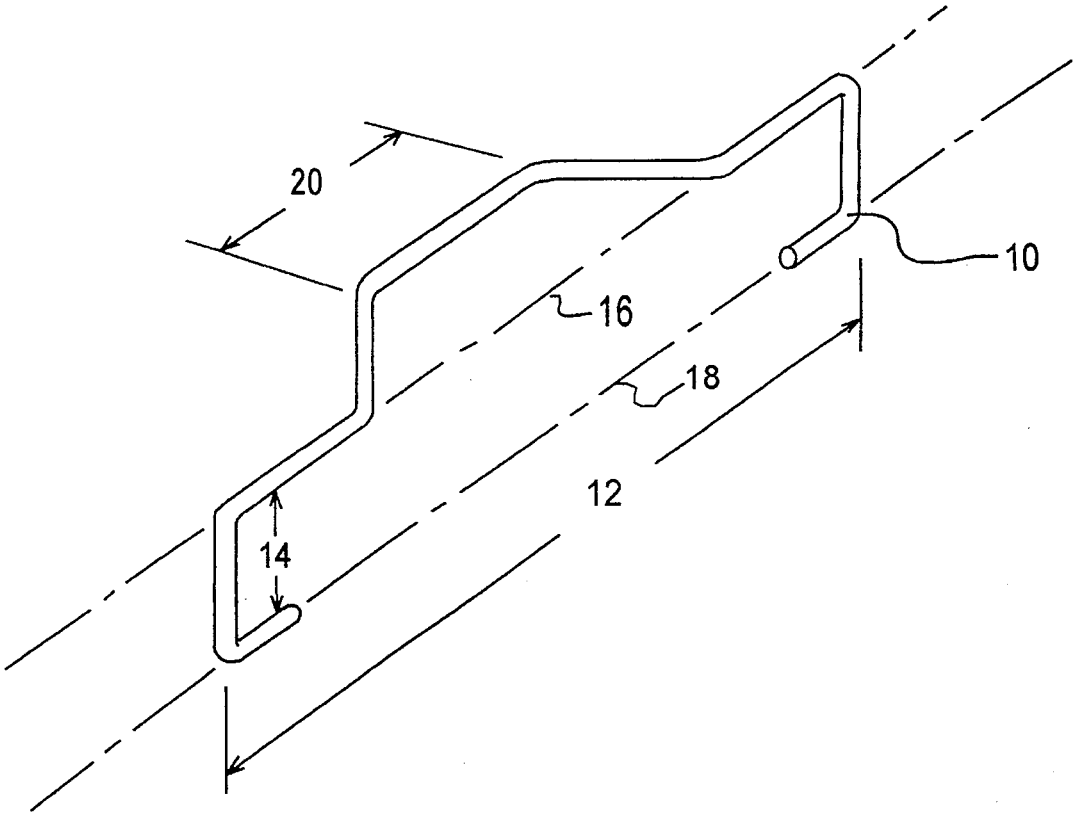
FIG. 1 is a perspective view of the entire invention.

Shown in FIG. 1 is a perspective view of a basic version of my foot stop consisting of a single rigid structural member, in this case a formed stainless steel tube 10, where the overall length 12 of the foot stop is essentially the same as the mattress width on which it is to be used and incorporating opposing U shaped sections at each end that have inner dimensions 14 essentially equal to the thickness of the mattress on which it is to be used. One leg of each U section is interconnected with a section of the stainless steel tubing so that the legs of the U section tubing are on the same center lines 16 & 18. The interconnecting tubing has a formed off set which results in a foot rest area 20 that is offset from the centerline of the interconnecting tubing in a direction generally 90° from the U sections.

Figure 2:
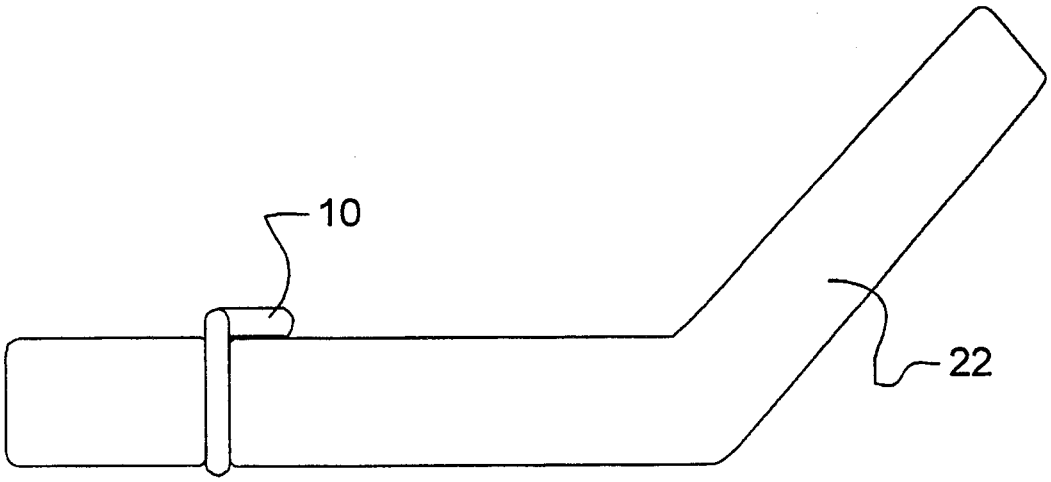
FIG. 2 is a side view of the invention as installed on a mattress of a hospital bed.

Shown in FIG. 2 is a side view of a hospital type mattress 22, with head elevated, and my foot stop 10 installed on the mattress.

Figure 3:
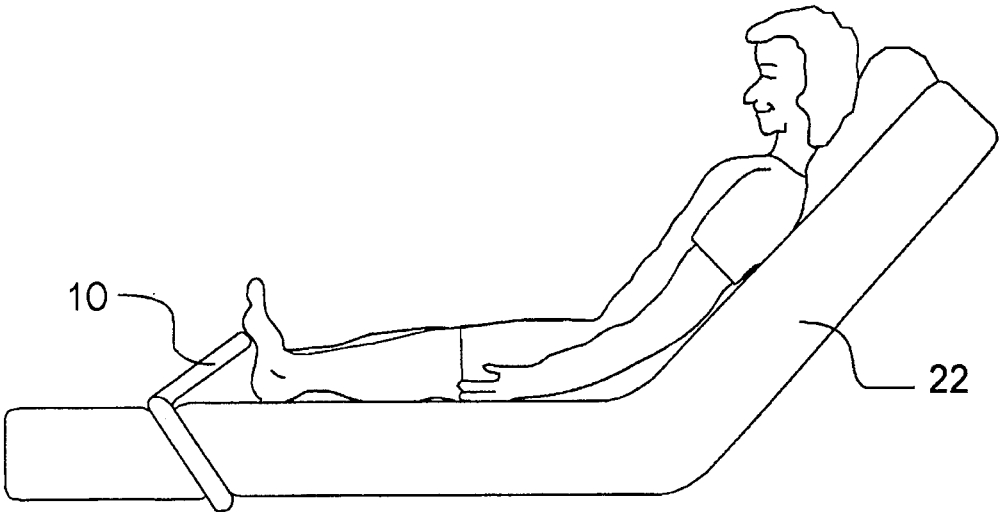
FIG. 3 is a side view of the invention as installed on a mattress of a hospital bed with foot pressure applied.

Shown in FIG. 3 is a side view of a hospital type mattress 22, with head elevated, and my foot stop 10 installed on the mattress and foot pressure being applied to the foot rest area 20.

Figure 4:
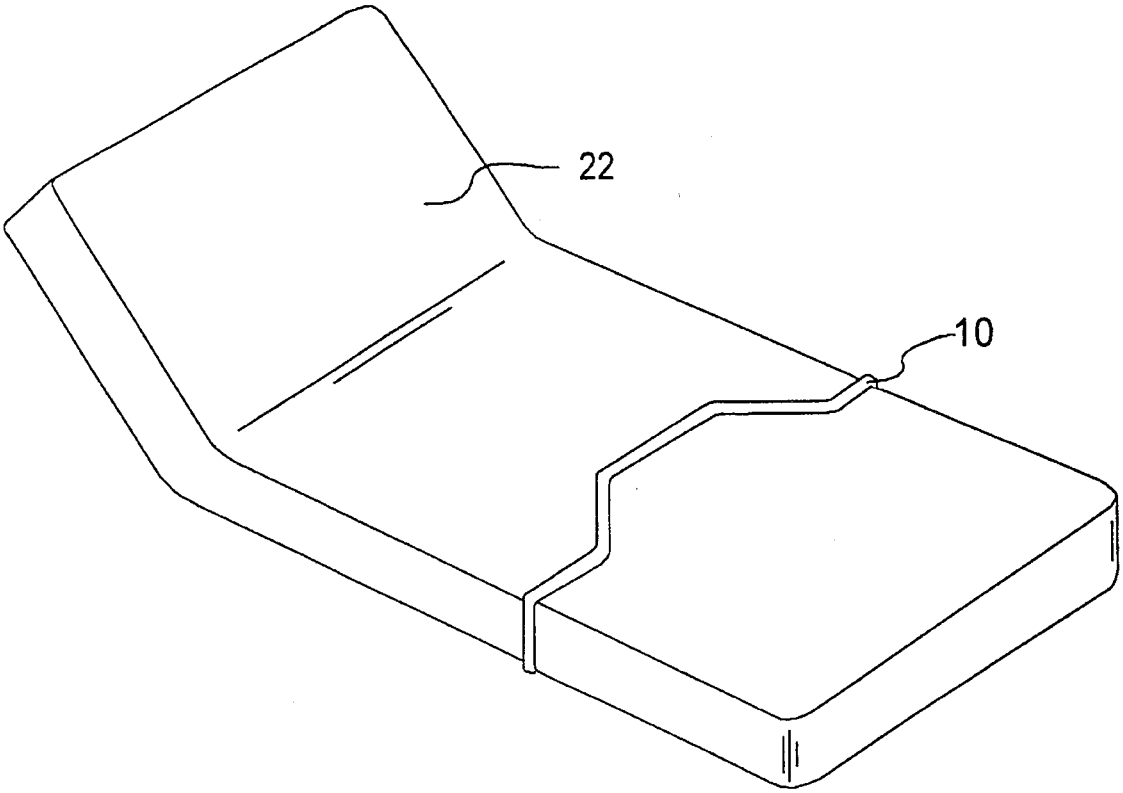
FIG. 4 is an perspective view of the invention as installed on a mattress.

Shown in FIG. 4 is a perspective view of my foot stop as installed on a hospital type mattress 22 where the head of the mattress is elevated.

OPERATION OF INVENTION

FIG. 4 shows the invention installed on a hospital type mattress wherein all inner surfaces are in contact with the mattress with the exception of the foot rest offset in the interconnecting tubing.

FIG. 2 shows a side view of the same thing and more clearly emphasizes the off set foot rest.

FIG. 3 shows how the invention is pivoted on the mattress when foot pressure is applied to the offset foot rest in the direction of the foot of the bed thus creating a locking action on the mattress preventing further movement in that direction thus stopping the slide of the human body toward the foot of the bed.

As seen in the Figures, the U shaped sections have inner dimensions essentially equal to the thickness of the mattress on which they are positioned, with the upper arms of the U shaped sections overlying and contacting the top portion of the mattress, and the lower arms of the U shaped sections overlying and contacting at least a portion of the bottom of the mattress. While not shown in the Figures, the offset foot rest area may include a padding to provide a softer surface for the feet pressed against it.

SUMMARY RAMIFICATIONS, AND SCOPE

Many other uses and variations of the invention will be apparent to those skilled in the art, and while specific embodiments of this invention have been described, these are intended for illustrative purposes only. It is intended that the scope of the invention be limited only by the attached claims.

We claim:

1. A foot stop for a user resting on a mattress, the foot stop adapted to be removably attachable to said mattress, comprising a unitary, generally rigid structural member incorporating opposing U shaped sections at each end that have inner dimensions essentially equal to the thickness of the mattress, with the upper arms of the U shaped sections adapted to overlie and contact the top portion of the mattress, the lower arms of the U shaped section adapted to underlie and contact at least a portion of the bottom of the mattress, the upper arms of the U shaped sections that are adapted to overlie the top portion of the mattress having an offset foot rest area generally overlying a central area of the mattress, and adapted to provide a support for the soles of the feet of a user.

2. The foot stop of claim 1, wherein said structural member is steel tubing.

3. The foot stop of claim 1, wherein the lower arms of the opposing U shaped sections are integral and contact the bottom of the mattress throughout the width of the mattress.

* * * * *